US005786794A

United States Patent [19]

Kishi et al.

[11] Patent Number: 5,786,794

[45] Date of Patent: *Jul. 28, 1998

[54] DRIVER FOR FLAT DISPLAY PANEL

[75] Inventors: Tomokatsu Kishi; Shigeki Kameyama; Kazuo Yoshikawa; Akira Otsuka; Tadatsugu Hirose, all of Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 443,038

[22] Filed: May 17, 1995

Related U.S. Application Data

[63] Continuation of Ser. No. 188,910, Jan. 31, 1994, abandoned.

[30] Foreign Application Priority Data

Dec. 10, 1993 [JP] Japan ..... 5-310258

[51] Int. Cl.[6] ..... G09G 3/28; G09G 3/30

[52] U.S. Cl. ..... 345/60; 345/76

[58] Field of Search ..... 345/60, 76, 208; 315/169.3, 169.4

[56] References Cited

U.S. PATENT DOCUMENTS 4,070,663 1/1978 Kanatani et al. .
4,707,692 11/1987 Higgins et al. .
4,866,349 9/1989 Weber et al. .
5,081,400 1/1992 Weber et al. .

FOREIGN PATENT DOCUMENTS 0 106 942 5/1984 European Pat. Off. .
0 549 275 6/1993 European Pat. Off. .
3-061994 3/1991 Japan .
4-301676 10/1992 Japan .
5-265397 10/1993 Japan .

*Primary Examiner*—Jeffery Brier
*Attorney, Agent, or Firm*—Staas & Halsey

[57] ABSTRACT

A flat panel display has a low withstand voltage and performs high speed line sequential scanning and recovers power. An AC type panel display has electrodes arranged in a matrix form, a push-pull type driver circuit, having first and second transistors, provided for each pair of plural pairs, of power supply lines connected to a driver circuit for driving a plurality of display electrodes to be scanned and a power supply which supplies a defined voltage to one of the respective power supply lines of each pair connected to the corresponding driver circuit, and a leakage control switch which leaks the defined voltage applied to the power supply line.

41 Claims, 7 Drawing Sheets

DRIVER FOR FLAT DISPLAY PANEL

This application is a continuation of application Ser. No. 08/188,910, filed Jan. 31, 1994, now abandoned.

BACKGROUND OF THE INVENTION

1. Field of the Invention

This invention relates to the field of flat panel displays and driving methods therefor and, more particularly, to a driver of the flat panel display by which a high speed method of line sequential scanning can be realized with low power dissipation and low cost.

2. Description of the Related Art

In recent years, there has been a greater demand for a flat matrix display, such as a plasma display (PDP), a liquid crystal display (LCD), or an elecroluminescent (EL) display, because of its much thinner structure compared to that of a CRT. Requests for, especially, a color display are frequent these days.

Flat displays, including a plasma display and an electroluminescent (EL) display, are thin. Moreover, the flat displays also permit large display screens. The application range and production scale of the flat displays are therefore rapidly expanding.

In general, a flat display utilizes charges accumulated between electrodes and causes a discharge, thereby to emit light for display. For a better understanding of the general principle of display, the structure and operation of, for example, a plasma display will be briefly described.

Well-known conventional plasma displays (AC type PDP) are a dual-electrode type that uses two electrodes for selective discharge (addressing discharge) and sustaining discharge and a triple-electrode type that uses three electrodes for addressing discharge.

In a plasma display (PDP) for a color display, ultraviolet rays resulting from discharges are used to excite phosphors formed in discharge cells. The phosphors are susceptible to the impact of ions or positive charges induced synchronously with the discharge. The above dual-electrode type has a structure such that the phosphors are directly hit by the ions. This structure may reduce the service lives of phosphors.

To avoid the deterioration, the color plasma display usually employs the triple-electrode structure which operates, based on surface discharge.

The triple-electrode type uses either an arrangement in which a third electrode is formed on the same substrate on which first and second electrodes for sustaining discharges are arranged or an arrangement in which a third electrode is formed on another substrate opposed to the one on which first and second electrodes are arranged.

In the arrangement in which three electrodes are formed on the same substrate, the third electrode may be placed on or under the two (i.e., first and second) electrodes for sustaining discharge.

Furthermore, visible light emitted from phosphors may be transmitted or reflected by the phosphors for observation.

The foregoing plasma displays of different types have the same principle. A description will therefore be made of a flat display in which first and second electrodes for sustaining discharges are formed on a first substrate and a third electrode is formed on a second substrate opposed to the first substrate, with reference to illustrated embodiments thereof.

That is, FIG. 3 is a schematic plan view showing a prior art configuration of a flat panel display.

FIG. 3 is a schematic plan view showing a configuration of the aforesaid triple-electrode type plasma display panel (PDP) 1 of plural discharge cells 10. FIG. 4 is a schematic crosssectional view of one of the discharge cells 10 formed in the plasma display panel 1 shown in FIG. 3.

As is apparent from FIGS. 3 and 4, the plasma display panel 1 comprises two glass substrates 12 and 13. The first substrate 13 has first electrodes (X electrodes) 14 and second electrodes (Y electrodes) 15. The first electrodes 14 and second electrodes 15 serve as sustaining electrodes, lie in parallel with one another, and are shielded with a dielectric layer 18.

A coat 21 made of magnesium oxide (Mgo) is formed as a protective coat over the discharge surface that is the dielectric layer 18.

On the surface of the second substrate 12, opposed to the first glass substrate 13, electrodes 16 acting as third electrodes or address electrodes are formed so as to intersect the sustaining electrodes 14 and 15.

On the address electrodes 16, phosphors 19, having respective red, green, and blue light-emitting characteristics, are placed in discharge spaces 20, each defined by walls 17 formed on the surface of the second substrate 12 on which the address electrodes are arranged.

Discharge cells 10 in the plasma display are separated from one another by partitions (i.e., walls 17).

In the plasma display of the aforesaid example, the first electrodes (X electrodes) 14 and second electrodes (Y electrodes) 15 are disposed in parallel with one another and are paired. The second electrodes (Y electrodes) 15 are driven separately by respective, separate Y electrode driver circuits 41, . . . , 4*n*, while the first electrodes (X electrodes) 14 form a common electrode which is driven by a single driver circuit 5.

Also, address electrodes 16-1, . . . , 16-*m* are orthogonally disposed to both of the X electrodes 14 and the Y electrodes 15, and are connected to a suitable address driver circuit 6.

In such a prior art flat panel display, each of the address electrodes 16 is separately connected to an address driver 6, which applies address pulses to the respective address electrodes during the address discharge period.

The Y electrodes 15-1~15-*n* are connected to respective Y-electrode scan drivers 4~4*n*.

The scan drivers 41 to 4*n* are connected to a Y-electrode common driver 3. For the addressing discharge, pulses are generated by the scan drivers 41~4*n*. For sustaining discharges, pulses are generated by the Y-electrode common driver 3, and then applied to the Y electrodes 15-1~15-*n* via the Y-electrode scan drivers 41~4*n*, respectively.

The X electrodes 14 are connected in common with respect to all display lines on a panel of the flat display.

An X-electrode common driver 5 generates a write pulse and a sustaining pulse, and applies these pulses to the X electrodes 14 concurrently. These drivers are controlled by a control circuit (not shown). The control circuit is controlled with a synchronizing signal which is supplied by an external unit. The X-electrode common driver 5 and Y-electrode common driver 3 in this example are connected to a suitable driver control unit (not shown). The X-electrodes 14 and Y electrodes 15 are driven all together by reversing polarities of applied voltages alternately. Thus, the aforesaid sustaining discharge is executed.

As mentioned above, the display panel 1 in the prior art flat panel display has m and n lines of the sustain discharge cell portions 10 arranged in horizontal and vertical directions, respectively, in matrix form, wherein the Y side scanning driver circuit 41 drives the Y electrodes which are connected to m number of the sustain discharge cell portions 10, disposed at the top of the lines arranged in the vertical direction, and also arranged in the horizontal direction, and similarly, each of the Y side scanning driver circuits **42–4*n*** separately drives a corresponding scanning display line of the Y electrodes.

On the other hand, the X side driver circuit 5 is connected through a common X electrode 14 to plural X electrodes 14-1, 14-2, 14-3 . . . **14-*n*, respectively in parallel with the Y electrodes 15-1, 15-2, 15-3 . . . 15-*n*, so that all of the X electrodes are simultaneously driven by the single X electrode driver circuit 5**.

The method to drive the prior art flat panel display mentioned above is now described, referencing FIG. 5 and 6.

That is, one frame of the display period S is divided into a scan address period S-1 and a sustain discharge period S-2 and thus the display operation is carried out by operating in these periods, sequentially.

In the scan address period, a scan signal is provided from the Y electrode scan driver circuit 41 to the Y electrode 15-1, and a signal, which corresponds to display data of the first line formed by Y electrode 15-1, is provided, from the address driver 6 to the address electrodes 16-1~**16-*m* using an address pulse AP, so that the cell portions 10** discharge temporally to enable a predetermined value of charge (wall charge) so that the cell can show a memory function deposited in this cell portion.

Similarly, data to be displayed is written into a defined cell portion by scanning the lines, sequentially, one-by-one (i.e., individually), in the order of the Y side electrode scanning drivers 42, 43, . . . , **4*n* and the associated Y electrodes 15-2, . . . , 15-*n***.

When the scan address period S-1 is completed, the sustain discharge period S-2 starts during which a defined voltage Ysus is simultaneously applied between the electrodes of the cell portion 10, which is formed at intersecting portions of the Y electrodes 15-1, . . . , **15-*n* and the X electrode 14, then the polarity of the voltage is inverted and a voltage Xsus is applied to the cell portion 10 by a similar operation, so that an alternating voltage is applied across the cell portions 10**.

Then, only in the cell portions 10 which have the predetermined value of charges (wall charge) developed therein during the scan address period, there takes place a luminous discharge repeatedly for a defined number of times.

Also, in the prior art flat panel display, for all of the cell portions 10, an initial operating period may be provided to eliminate the charges generated by the Y side common driver 3 and the X side common driver 5 within the cell portions which conducted, in a luminous discharging operation, in the previous sustain discharge period.

In this case, during the initial operating period, a method for initializing display data of each display line sequentially, one by one, may be used, and a batch eliminating method may also be used.

Also, an arrangement of the scan driver and sustain discharge circuit of the prior art flat panel display is shown in FIG. 7, wherein n driver circuits 41, . . . , **4*n* are provided, each of which has a push-pull type driver circuit 51 for driving the respective one of Y electrodes 15-1, . . . , 15*n*, which constitute a display line. At same time, one end 0 of the push-pull type driver circuit 51** is connected to Vs, as a first voltage source, via a suitable switch means SW1 and the other end P is connected to GND, as a second voltage source, via a suitable switch means SW2.

On the other hand, at the output of the push-pull type driver circuit 51, there are provided diodes DU1 . . . , DUn having a function to raise the voltage of the display line, diodes DD1, . . . , Ddn having a function to lower the voltage of the display line, and the driver 5 commonly driving the X electrodes comprises an output stage having transistors TR3 and TR4.

The method for driving the prior art flat panel display constituted as described above generates a sustain discharge wave in the Y electrode via diodes DU1, . . . , DUn and DD1, . . . , DDn by the Y side common driver circuit 3, whereby the output of the push-pull type driver circuit 51 is kept in high impedance state during the scan address period in which scan pulses are applied to the Y electrode by the push-pull type driver circuit 51 for scanning the Y electrode side.

Also, a sustain voltage wave is generated in the X electrodes by X electrode side driver circuit 5.

Next, another arrangement example of the prior art flat panel display will described, referencing FIG. 8.

That is, the flat panel display is generally called a floating system, wherein a power recovery circuit 60 is further provided to the driver circuit 3, for scanning.

That is, as can be understandable from the block diagram shown in FIG. 8, in the prior art flat panel display, each of the driver circuits 41, . . . , **4*n*, for the Y electrode side scanning, includes a switch means 52 which has a transistor TR5 connected to a defined writing voltage Vsc via a resistor R1 and a diode D030 connected in parallel with the transistor TR5, and a power recovery circuit 60** is also added.

Also, the X electrode driver circuit 5 has an output stage known in the prior art, and a power recovery circuit 60 connected said output stage at same time.

Also, a connection between each of the driver circuits 41, . . . , **4*n* for the Y electrode side scanning and the power recovery circuit 60, is made wherein each of the driver circuits 41, . . . , 4*n*** for the Y electrode side scanning is arranged to be an open-drain circuit.

Since a display panel is a capacitive load, the power recovery circuit 60 has a capability of recovering charge to be transferred in the panel, when a voltage is needed to produce a gas discharge in the panel, and it has a circuit construction to serially resonate by a panel capacitor Cp and a coil 61.

Operation of the flat panel display drive circuit shown in FIG. 8 will now be explained, wherein a fall of the scanning pulse occurs when the transistor TR5 in the switching circuit 52 is turned on, and a rise of the pulse may be taken by a method in which a charge current flows from a resistor R1 to the panel capacitor, or from the sustain discharge circuit provided in Y side common electrode driver 3 to a diode D030, when the transistor TR5 is turned off. The sustain discharge wave is generated by the driver circuit 5 for the X electrode side and the common driver circuit for the X electrode side through the diode D030 or transistor TR5 comprising a FET.

However, in the prior art flat panel display, as shown in FIG. 7, the withstand voltage of the driver circuit for scanning the Y electrode side is determined at approximately 200 volts, based upon the maximum voltage Vs of the sustain discharge wave, but not based upon approximately eighty (80) volt which is the voltage (Vsc) at scanning, therefore it is required to use a LSI having a large withstand voltage, so that the circuit arrangement becomes complicated as well as the manufacturing cost becomes very high.

Also, in the flat panel display shown in FIG. 8, it is required to raise or fall the voltage only by a resistor.

Therefore, the resistor is required to have a large value, which causes an increase in the time which elapses until a defined voltage is established; thus, it is not applicable to high speed line scanning.

Therefore, the resistor should have a small value, but when the value is decreased, a needless current can flow therein, so that the ON voltage of the driver circuit for scanning is required to be high, that is, the capacity of the panel is required to be large.

Also, if the resistor is not used, a method could be available wherein the potential is raised from the driver circuit common to the Y electrode.

In that case, a problem has existed that the current loss became high, since the scanning driver circuit was used both in the scan address period and in the sustain discharge period.

SUMMARY OF THE INVENTION

Therefore, it is an object of this invention to provide a flat panel display that overcomes the defects of the prior art, has a low withstand voltage, can perform fast line scanning and regenerate power and has a low power dissipation with a low cost.

In order to achieve the objects mentioned above, this invention employs a technical feature described below. In a first embodiment of the flat-panel display in accordance with this invention, there is provided a driver for a flat panel-display comprising at least two substrates, each having electrodes on the surface thereof arranged closely so that said electrodes intersect and face mutually, a plurality of intersections formed between said electrodes construct cells, a plurality of said cells are arranged in a matrix configuration to form a display panel, and each of the cells has a capability of a memory for storing a given amount of charge according to a voltage applied to an electrode in the cell and also has capabilities of discharge and light emission, wherein said driver comprises a push-pull type driver circuit, provided for each one of the electrodes, which is one of a pair electrodes between which discharge is conducted, a pair of the electrodes forming said cell; and further comprises a power supply circuit means for supplying a predetermined voltage to each of said driver circuits, and a leakage current control switch means for leaking current caused by said predetermined voltage applied to each of said driver circuits. Furthermore, a second embodiment of a flat panel display in accordance with this invention, essentially comprises the feature mentioned above, and also a power recovery circuit which is connected to the electrodes, the electrodes comprising the display line in the flat panel display.

In the flat panel display in accordance with this invention, in order to solve the problem mentioned above, the technical feature described above is utilized, so that, during the period wherein each of the Y electrodes, consisting of the display line, writes display data in the cell portion, a signal voltage for scanning is applied for example, during a scan address period and a sustain discharge voltage is applied during the period for discharging the cell portion to which the display data is written for a defined time, for example, the sustain discharge voltage is applied thereto during the sustain discharge period. Accordingly, since a different voltage is applied to a display line of Y electrodes during a different display operation period, the circuit construction is simplified and driver can be used while completely eliminating the effect of the voltage, applied thereto during a different period, even though a different voltage is applied to the same electrode during different period, and thus the withstand voltage of the respective circuit can be lowered since the voltage used will not become higher than the defined voltage.

Also, the driver circuit for driving the Y electrode is provided with two power supply lines (FVH and FLG), and two systems of power recovery circuit 60 connected to two power supply lines connecting the respective driver circuits so that a part of power generated in the circuitry of the flat panel display can be used to make a power saving type flat panel display.

DETAILED DESCRIPTION OF THE PREFERRED EMBODIMENT

An embodiment of a flat panel display in accordance with this invention will now be described in detail with reference to the drawings.

Figure 1:
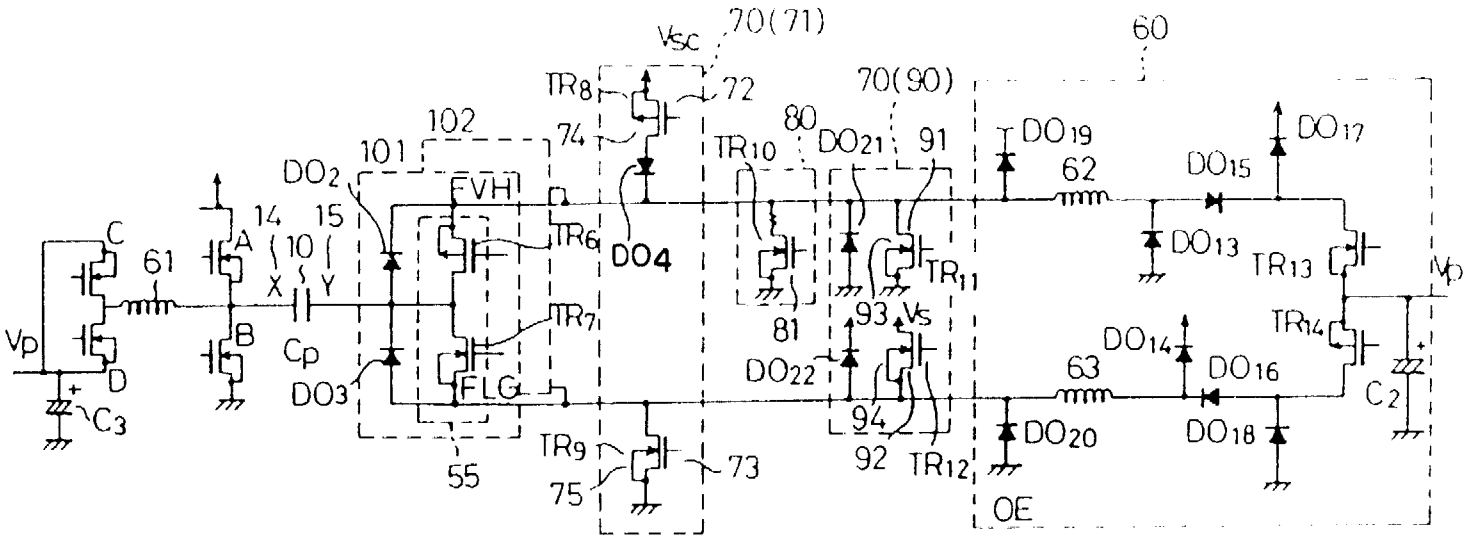
FIG. 1 is a block diagram showing a circuit constitution of an embodiment of a flat-panel display according to this invention.
Figure 3:
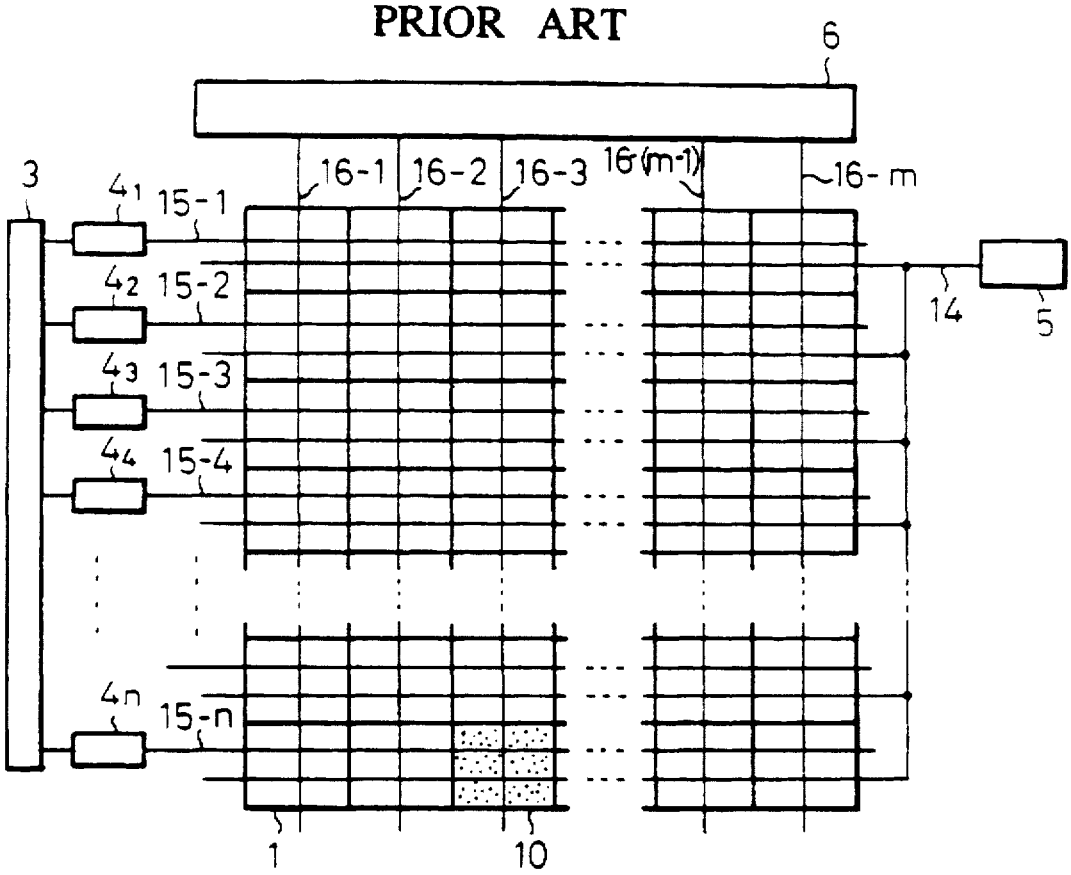
Fig. 3 PRIOR ART
FIG. 3 is a plan view of the prior art flat-panel display.
Figure 4:
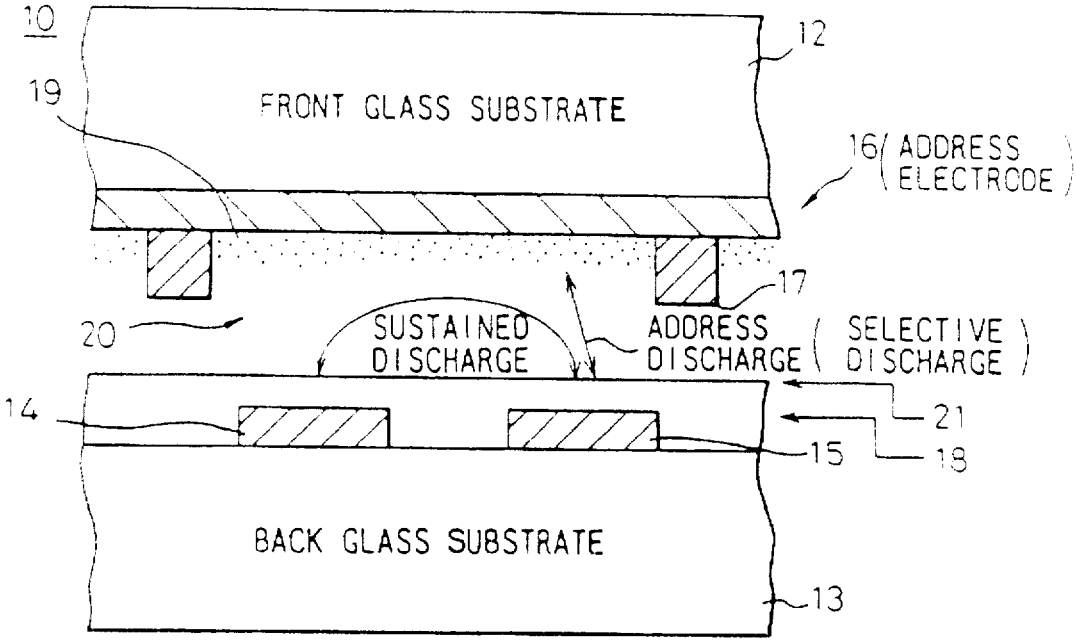
Fig. 4 PRIOR ART
FIG. 4 is a crosssectional view of a cell of the prior art flat-panel display of FIG. 3.
Figure 5:
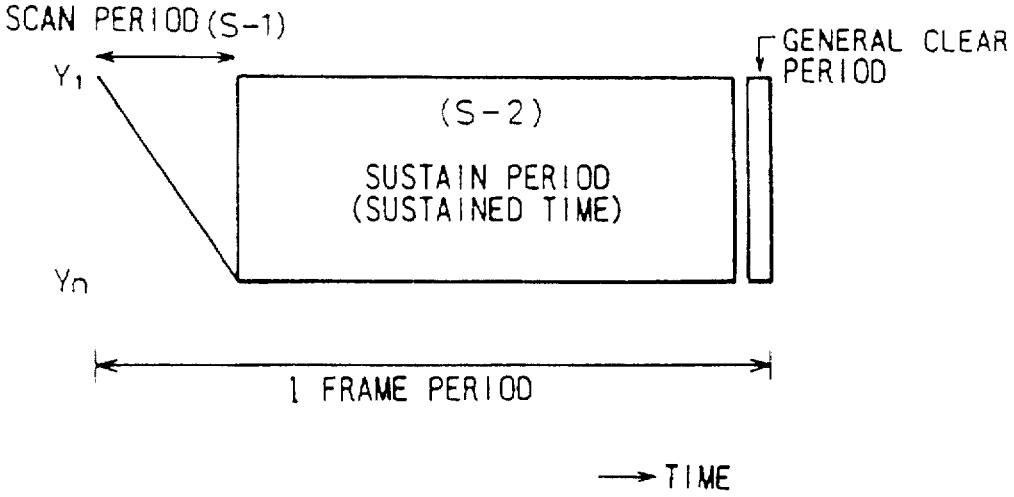
Fig. 5 PRIOR ART
FIG. 5 is a timing chart for describing an example of the driving method of the prior art flat-panel display.
Figure 6:
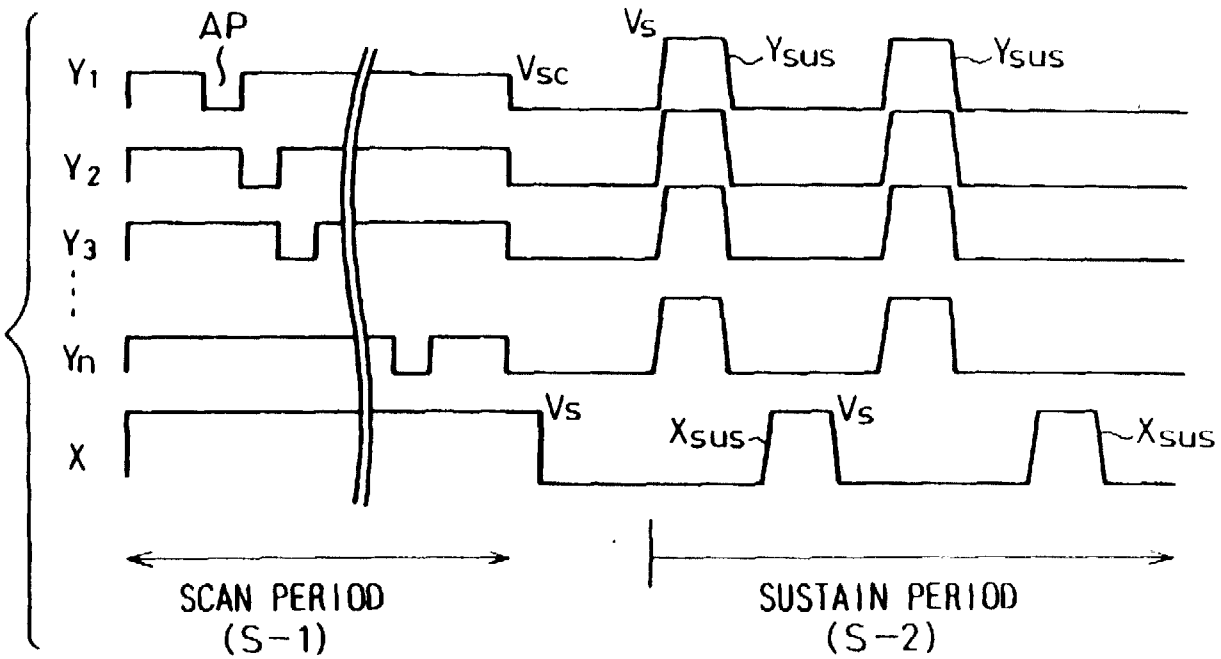
Fig.6 PRIOR ART
FIG. 6 shows detailed examples of the driving voltage waveforms for operating the prior art flat-panel display.
Figure 7:
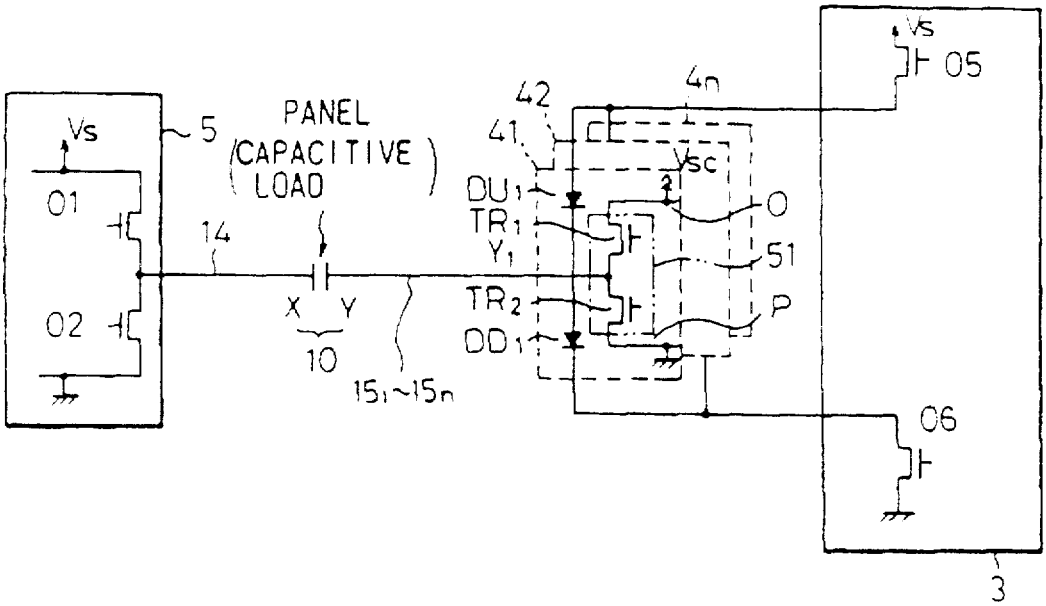
Fig.7 PRIOR ART
FIG. 7 is a block diagram of an example of the drive unit of the prior art flat-panel display.

FIG. 1 is a block diagram showing an embodiment of an arrangement of the flat panel display drive circuits in accordance with this invention, wherein the panel may have the structure, shown in FIGS. 3 and 4, of at least two substrates 12, 13 on which electrodes 14, 15 are disposed, adjacently positioned in such a manner that the electrodes are facing each other; a suitable fluorescent substance 19 is, for example, inserted between the substrates 12 and 13; a plurality of orthogonal portions, formed by the electrodes orthogonally intersecting each other, define cell portions 10, each of which constitutes a pixel; and the cell portions 10 are arranged in a matrix form thereby to form a display panel 1 and to have a memory function which is able to store a predetermined amount of charges, and a luminous discharge function; in order to select cell portions for performing a write operation, for writing suitable display data into cells, the sequence of display operations is defined as comprising a period for scanning to select a line, from the plurality of display lines and in a line sequence method, and writing the display data into the cell portions of that line, for example, an address period S-1; and a period for illuminating the cell portions 10, into which the display data is written, multiple times, by discharging the cell portions and comprising, for example, a sustain discharge period; and wherein push-pull driver circuits 55 are provided in parallel, each of which having, for example, two transistors TR6 and TR7. The push-pull driver 55 is connected to each of two power supply lines FVH and FLG, connected, for example, to a driver circuit for driving one of the electrodes forming a plurality of display lines to be scanned, for example, a Y electrode 15; it is also provided with a power supply source 70 which applies a defined voltage, that is a voltage of a first power supply line, to at least one of the power supply lines respectively connected to the driver circuits. Further, a switch 80 leaks a defined voltage applied to the respective power supply lines connecting the driver circuits.

In FIGS. 3 and 4, it is desirable that the display panel 1, in the flat display panel system in accordance with this invention, comprises three electrodes including an X electrode 14, Y electrode 15 and an address electrode 16 for driving and displaying an image, and for the display, it is desirable that display panel 1 is either the plasma display panel (PDP) or the electroluminescence (EL) panel type.

That is, the driver of the flat-panel display, according to this invention, is provided with a power supply circuit 70 for supplying or cutting off the voltage (OFF voltage Vsc, when scanning operation is carried out) of the first voltage supply means, such as a scanning voltage, to the power supply line common to Y electrode scanning driver circuits 101, 102, . . . , 10*n* and the Y electrode scanning driver circuits having the push-pull circuit 55, providing an ON voltage (e.g., GND) and an OFF voltage (e.g., Vsc) needed for scanning a scan electrode 15, to one of the power supply lines (first power supply line) which connect the driver circuit; and a switching circuit 80 having a transistor switch 81 for leaking current caused by the voltage used for scanning and applied to the respective power line of the scan driver circuits 101, 102, . . . , 10*n* to force the voltage of the power supply line to be zero voltage or ground.

Furthermore, the power supply 70 comprises a first power circuit 71 which applies a defined voltage, e.g., Vsc, to at least one of two power supply lines FVH and FLG, e.g., FVH1, . . . , FVHn (the first power supply line) connecting the driver circuit during the scan address period (S-1) wherein the display data is written into the cell portion, and a second power circuit 90 which applies a defined voltage to the power supply lines FVH1, . . . , FVHn during the sustain discharge period (S-2) wherein the cell portion, into which the display data is written, is allowed to discharge for a defined period.

Furthermore, it is desirable that the first power supply means 71 be provided with a first voltage generating unit 72 for generating a high voltage supply, e.g., Vsc, a second voltage generating unit 73 for generating a low voltage supply, e.g., a ground level voltage, wherein the first voltage generating unit 72 is connected to one connecting wire, e.g., FVH (the first power supply line) of two power supply lines (FVH, FLG), and the second voltage generating unit 73 is connected to one connecting wire, e.g., FLG (the second power supply line) of the other of two power supply lines (FVH, FLG).

It is desirable that the above mentioned voltage generating units 72, 73 used with this invention are respectively provided with switches 74, 75, which supply a defined voltage to any one (e.g. FVH1, . . . , FVHn) of two power supply lines (FVH1,~FVHn and FLG1~FLGn) connected to the driver circuits, in response to a predetermined control signal supplied externally to the switching means.

It is also desirable that the switch units 74, 75 include MOSFETs (TR8, TR9) respectively.

It is also desirable that a diode D04 or a resistor R, or both, be provided between the first voltage generating unit 72 of the first power supply means 71 and one, e.g., FVH (the first power supply line) of two power supply lines connected to the driver circuit, used with the driver of the flat panel display of this invention.

On the other hand, in the driver of the flat panel display according this invention, the second power supply means 90, in the power supply circuit 70, used with the driver of the flat panel display of this invention, has voltage generating means 91, 92 which generate two different potentials, respectively, and which are respectively connected to the power supply line and the display line (FVH, FLG) connecting to the driver circuit.

In this embodiment, the first voltage generating means 91 for supplying GND potential is connected to the power supply line FVH, for example, one of two power supply lines connecting the driver circuit, and the second voltage generating means 92, generating high voltage Vs, is connected to the other power supply line FLG (the second power supply line) of the two power supply lines connecting the driver circuit.

Furthermore, each of the voltage generating means 91, 92, comprising the second power circuit 90 in accordance with this invention, is provided with switching means 93, 94, respectively and is arranged to supply a defined voltage to any one (e.g., FVH or FLG) of the power supply lines connecting the driver circuit by a defined control signal supplied externally.

Furthermore, the switch unit 93, 94 are provided with MOSFETs (TR11, TR12) respectively.

Note that diodes D021, D022 may be connected in parallel to the MOSFETs (TR11, TR12) which constitute the switching units 93, 94 provided in the voltage generating units 91, 92 in the second power means 90 described above.

On the other hand, it is desirable that diodes D02, D03 are connected in parallel to the transistors TR6, TR7 of the push-pull type driver circuit 55, used for the scanning driver circuit 101 of the Y electrode side.

Also, the power supply lines connected to each of the driver circuits of the Y electrode side used with this invention have two power supply lines (FVH, FLG) between which the push-pull type driver circuit 35 is connected in parallel.

It should be noted that the other electrode, i.e., the X electrode, is a common electrode.

Also, the above mentioned leak current control circuit 80 used with this invention may have a switch 81 which is constituted by, for example, a MOSFET (TR10), and which is connected to the power supply line (FVH) to which the first voltage generating unit 72 is connected.

Next, it is desirable that, in the flat panel display according to the invention, a power recovery circuit 60 is connected to each of the power supply lines (FVH, FLG) which constitute two power supply lines connecting the driver circuit.

It is desirable that the power recovery circuit 60 is constituted by a resonant circuit which includes capacitors provided by the display panel 1, and coils 62, 63 connected together through diodes, e.g., D02 and D03, respectively. In this embodiment, the inductance values of the coils 62 and 63 in the recovery circuit 60, having the panel capacitors and the coils connected through diodes, are set at respective, different values.

That is, the power recovery circuit 60 has two systems of L-C resonant circuits with respective diodes and MOSFETs which are connected to the resonant circuit, further, the power recovery circuit 60 is able to clamp the voltage, from a peak voltage generated during the resonance to a defined voltage (Vs or GND), whereby part of the power is stored in a capacitor described hereunder to be used during the next scanning period.

The above mentioned second power supply circuit 90 has a switch function for supplying a current during the sustain discharge period wherein an illumination for display is repeated.

Note that the detailed circuit configuration of the power recovery circuit 60 is not specifically limited. Therefore any recovery circuit known in the prior art may be used, so that the recovery circuit formed by diodes D013, D014, D015, D016, D017, D018, D019, D020, and MOSFET (TR13, TR14) other than coil 62, 63, and further a capacitor C2, arranged in the configuration as shown in FIG. 1 can be used.

Each of these diodes used for the power recovery circuit 60 has a function for eliminating parasitic inductance components generated within the circuit, in relation to the coil 62, 63.

Figure 8:
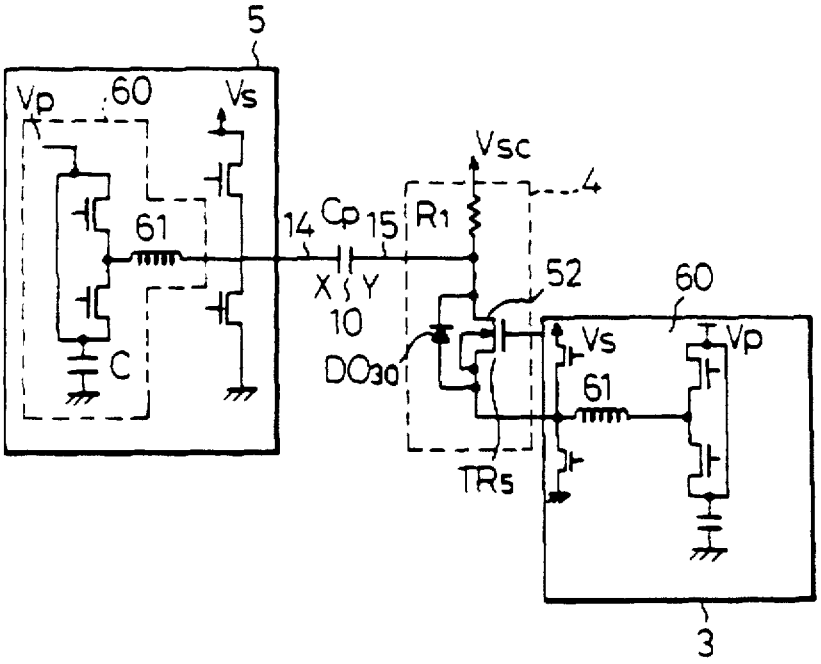
Fig. 8 PRIOR ART
FIG. 8 is a block diagram of another example of the drive unit of the prior art flat-panel display.

Note that the driver circuit used for the prior art flat-panel display shown in FIG. 8 may be used for the common driver circuit of the X electrode side.

Also, the first voltage generating means 91 in the second power supply circuit 90 may be eliminated when the switch means 80 is used in the drive unit of the flat panel display according this invention.

In another embodiment of the present invention, a suitable resistor is provided between the leakage current control switch 80 and one of the two power source lines connected to the driver circuit, for example, FVH, so as to prolong a transistion time of a trailing edge of the scanning pulses.

As an alternate embodiment in accordance with this invention, a suitable driving operation is performed on the assumption of the constitution mentioned above, however, the essential constitution of the driving method for a flat-panel display comprises a push-pull type driver circuit comprising two transistors provided for respective ones of the electrodes forming a pair of the electrodes for discharging, which form the cell, and a first power supply means for supplying a defined voltage to each of the electrodes during a period wherein display data is written into the cell portion, and a second power supply means for supplying a defined voltage to each of the electrodes during a period wherein the cell, to which the display data is written, discharges for a defined time, and a leakage current control switch means for leaking the defined voltage applied to each of the drivers. The driving method comprises the steps of operating the first power supply means so as to apply a defined voltage to the electrodes before writing display data to the cell portions.

Disabling the operation of the first power supply means enables the leakage current control switch means, so that a voltage difference between the power supply lines of the electrode is eliminated, immediately before completing the period wherein the display data is written into the cell portion; and operating the second power supply means to apply an alternating voltage to the electrode during the period wherein the cell portions discharge for a defined time.

Also, an alternate embodiment of the driving method of the flat-panel display in accordance with this invention may be provided wherein the voltage difference of both ends of the push-pull type driver circuit 101 during the period when the cell portions discharge for a defined time, that is, the sustain discharge period S-2 is kept at zero to carry out a display process.

Furthermore, diodes D02 and D03 are connected in parallel to the transistors TR6 and TR7, respectively, of the push-pull type driver circuit 101, and thereby the sustain discharge voltage during the sustain discharge period S-2 may be applied from the second power circuit 90 to the display panel through only the diodes D02 and D03.

An embodiment of the driving method of the driver of the flat panel display in accordance with this invention will now be described with reference to FIG. 2.

Figure 2:
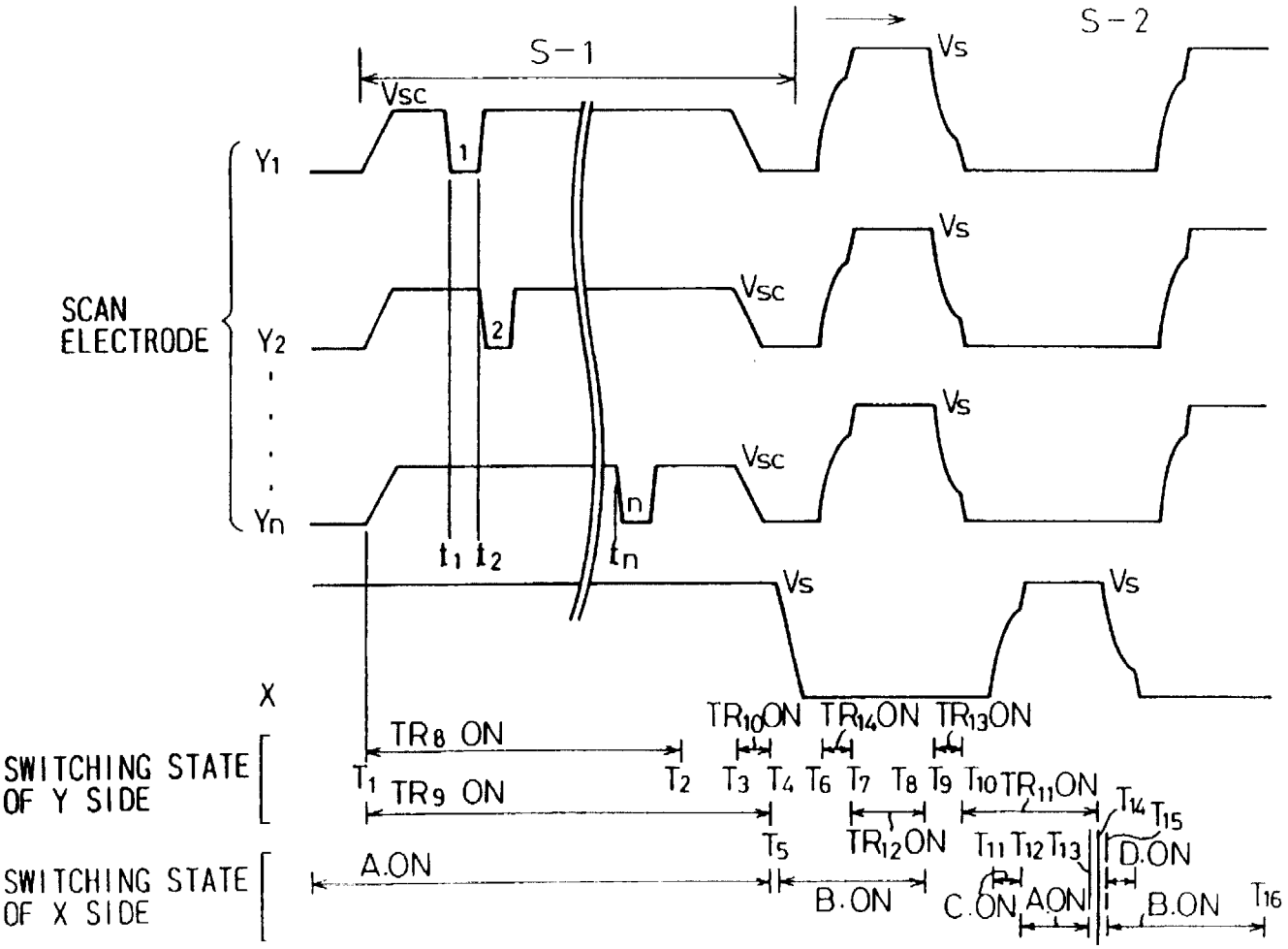
FIG. 2 shows detailed examples of the driving voltage waveform for operating the drive unit of the flat-panel display shown in FIG. 1.

Note that the address electrode is eliminated in FIG. 2.

In the driving method of the driver in the prior art, scanning pulses are supplied to the Y electrode side for selecting each of the Y electrodes in a line sequential manner one by one, and Vsc is output to one line as the scan voltage and the other line is grounded during that time, whereby the voltage Vsc is applied between the lines for scanning.

In this invention and in contrast to the prior art scanning method, a zero voltage is applied to each of the electrodes to be scanned as an OFF voltage for scanning. The reason for adapting such a method is that, in the flat panel display, both of the voltage waveform Vsc (approximately 80 volts) for scanning, to be used during the scan address period S-1 wherein display data is written into the cell, and the sustain discharge voltage wave (e.g., approximately 200 volts) to be used during the sustain discharge period S-2 wherein the cell portion to which the display data is written is discharged for a defined period, are applied to two power supply lines FVH and FLG which are connected to the driver circuit for driving the respective Y electrode, i.e., scanning electrode. Therefore, if the voltage used during the scan address period remains on the power supply lines FVH and FLG, the sustain discharge voltage used during the sustain discharge period is added to that voltage, so that a high voltage such as 280 volts will be applied to the electrode that requires the withstand voltage to be raised.

Therefore, in this invention, a novel technical feature is employed wherein each of the power supply lines connected to a driver circuit for driving the scanning electrode mentioned above is commonly used in the scan address period S-1 and in the sustain discharge voltage S-2. In order to avoid the problem for the withstand voltage, the voltage applied to the power supply lines during a specified period is eliminated, once, to thereby change voltage of the power source line, to 0 volt, and then a defined voltage, which is to be used during the other operation period, is newly applied thereto.

That is, immediately before the Y electrode 15 engaged in the scan address period S-1 as shown in FIG. 2, the MOSFET transistor TR6, which comprises the scan driver circuit 101 of the Y electrode, is set to an ON condition. At the same time, the MOSFET transistor TR8, which constitutes the first voltage generating means 72 in the second power supply means 71, is set to an ON condition. Also, the MOSFET transistor TR9 is turned ON, simultaneously. During this period, the MOSFET transistor A which constitutes the common driver 5, common to the X electrodes 14, is set to an ON condition, and thus the voltage between power supply lines FVL and FLG connected to the driver circuit for driving the Y electrode 15, and simultaneously the voltage Vs are applied to the X electrode.

As a result, each of the Y electrodes (15-1, . . . , **15-*n*) is charged up to the voltage Vsc through a rapid charging period (T1), and holds a defined voltage Vsc substantially to the end of the scan address period S-1. On the other hand, each of the Y electrodes (15-1, . . . , 15-*n*) is charged up to the voltage Vsc, and the first transistor TR7 of the pull (PULL) side, which is connected to one of the power supply lines (FLG1) which are connected to the driver circuit 101, is turned ON, for driving the first line of Y electrode (15-1), and the transistor TR6 of the push (PUSH) side is turned to an OFF state, whereby the Y electrode is grounded. At the time t1, an address output, which corresponds to the display data which is related to the power supply line FVH connected to the driver circuit for driving the Y electrode 15-1, and corresponds to the Y electrode 15-1, is applied to the address driver 6** to write the data.

In the data write operation, the cell portion 10 connected to the Y electrode selected by the address data, discharges to produce a defined charge in the cell portion 10, and afterwards the cell portion 10 which discharges cases the discharge, due to the charge (wall charge) of the cell 10 itself.

Note that during that period, the transistor TR6 of the push (PUSH) side in the driver circuit 101 for driving each of the Y electrodes 15-2, . . . , **15-*n***, i.e., the other electrodes, is set to an ON state.

Such a scanning is performed for each of the Y electrodes 15-2, . . . , **15-*n*, and at time T2, immediately before the end of the scan address period S-1, a MOSFET transistor TR8, constituting the first voltage generating means, is set to an OFF condition and at time T3, after a defined period of time has elapsed, a MOSFET transistor TR10 of the leakage current control switch mean 80** is set to an ON condition.

In this state, the MOSFET transistor TR9, constituting the second voltage generating unit 73, is turned ON so that at the time T4 a high voltage, i.e., Vsc, which charges the power supply lines FVH and FLG connected to the driver circuit for driving the Y electrode, is applied via the MOSFET transistor TR10 to ground so that the voltage between the power supply line FVH and FLG becomes zero.

Note that the MOSFET transistor TR9, constituting the second voltage generating unit 73, is turned OFF at the time T4.

At the same time, the MOSFET transistor A, constituting the common driver 5 of the X electrode, is set to an OFF condition at the time T4 at which the scan address period S-1 ends.

That is, the potential of the X electrode is set at zero at the same time the voltage of all Y electrodes is set at zero volts via the diode D02 of the scan driver 101 for scanning, and is set at zero volts at the point between the power supply lines FVH and FLG and thus the scan period is completed. Then, the voltage Vs is applied to the X electrode so that the discharge will not extend in the vertical direction.

Next, during the sustain discharge period S-2, the discharged cell portion 10 during the address period mentioned above still holds the charge (wall charge) in the cell portion 10 to be displayed, so that an alternate voltage is applied only to the cell portion wherein the charge (wall charge) remains for repeating the discharge to enable display.

Note that if a sustained discharge is to be performed, the same alternating voltage is applied to all Y electrodes at the same time.

At first, during the initial sustain discharge period, the defined voltage Vs is applied to the Y electrode, and at the time T5 the transistor B in the X electrode side is turned ON so that X electrode holds zero voltage.

Then, at the time T6, the transistor TR1, provided in the power recovery circuit 60, is turned ON, so that part of the power stored in a capacitor C2 charges the power supply line FLG to raise the potential of one FLG of the power supply lines connected to the driver circuit for driving the Y electrode.

If the charge on the capacitor C2 is sufficient, the voltage of the power supply line FLG connected to the driver circuit for driving the Y electrode is increased, up to the defined voltage Vs, but generally it is not possible for the voltage to be increased up to Vs. At time T7, the transistor TR14 is turned OFF and, at the same time, the MOSFET (TR12), which is the switch means 94 provided in the second voltage generating means 92 which is provided in the second power supply 90, is turned ON to raise the voltage Vs of the power supply line FLG.

Of course, in this invention, if the power recovery circuit 60 is not used, the voltage of the power supply line FLG is raised up to the defined voltage Vs by the second voltage generating means 92 provided in the second power supply 90.

The voltage mentioned above is applied to the cell portion of the display panel via the diode D03.

At the time T8, the second voltage generating means 92, provided in the second power supply 90, is turned OFF and at same time the transistor B, in the driver circuit 5 of the X electrode, enters an OFF condition.

Next, at the time T9, the transistor TR1 provided in the power recover circuit 60 is turned ON, and part of the voltage Vs charging the line connection FVH charges the capacitor 2 to store the charge, which is used for discharging operation of the Y electrode, in the next step.

The voltage of the power supply line FVH is rapidly decreased by the scanning, and at the time T10 the transistor TR13 is turned OFF and simultaneously the MOSFET (TR11), which is the switch unit 93 provided in the first voltage generating unit 91 which is provided in the second power supply 90, is turned ON to drop the voltage of the wiring connection FVH completely to zero volts.

With this operation, the first sustain discharge operation of the Y electrode is completed, and the sustain discharge operation of the X electrode is then performed.

On the X electrode side, at the time T11, the MOSFET transistor (TR11) is in an ON condition so that the potential of the X electrode is raised and, at the time T12, the MOSFET transistor C is turned OFF and, simultaneously, the transistor A is turned ON so that the potential of the X electrode is raised to the defined voltage Vs.

During this period, the voltage on the Y electrode side of the cell portion is kept at zero volts since the ground potential voltage is supplied through the diode D02 and D03 to the electrode.

Next, at the time T13, both MOSFET transistors (TR11) and A are simultaneously turned OFF but, at the time T14, both the transistors D and B are turned ON so that the voltage of the X electrode falls to zero volts and part of the charge stored in the cell portion 10 charges the capacitor C3 to conclude the first sustain discharge operation of the X electrode side.

Then, the discharge operations on the Y and X electrode sides are alternately repeated for a defined number of times so as to illuminate the defined cell portion 10 of the display panel with a defined brightness.

Note that the brightness level at the cell portion 10 is decided by the given number of times of the application of the alternating voltage.

Furthermore, referring to the operation of the power recovery circuit 60 according to this invention, all Y electrodes are charged to Vs by the external voltage supply Vp set to a defined potential, for example to an intermediate voltage between the voltage Vs and GND, through the series LC resonant path of the transistor TR14, diode D016, coil 63, diode D03 of the serial resonant LC circuit, and the transistor TR11 is turned ON approximately at the peak voltage of the LC resonant circuit to apply the voltage Vs.

At this moment, the cell portion, wherein more than a certain level of the wall charge remains, produces the sustained discharge since the sum of an applied voltage Vs and the quantity of the residual wall charge exceeds the discharge starting voltage of the rare gas.

After termination of the discharge by removal of the wall charge itself, the Y electrode is grounded and, then, the charge Cp stored in the display panel is transferred to the external power supply Vp.

Then, all of the Y electrodes discharge from the display panel capacitor Cp to ground via the series resonant path of the diode D02, coil 62, diode D015, and transistor TR13, but part of the charge is stored in the capacitor C2 for further use in the next sustain discharge operation, and at approximately the peak of the LC resonant voltage, the transistor TR11 is set to an on state, whereby the potential of the Y electrode is kept at ground level which terminates the generation of the sustain discharge wave.

Similarly, the sustain discharge wave is produced at the next cycle and, by repeating this operation, a sequence of the sustain discharge periods is formed.

When the display operation mentioned above is completed, the wall charges in all of the cell portions 10 are eliminated by an initialization operation, so as to prepare to perform the next frame operation.

The drive unit of the flat panel display in accordance with this invention employs the technical architecture as described above whereby the withstand voltage in the scanning side driver circuit can be restrained to a low level.

That is, the withstand voltage of the drive unit of the flat panel display in accordance with this invention can be affected by Vsc, since the output voltage difference is zero volts between the two power supply lines FVH and FLG connected to the driver circuit for driving the sustain discharge type Y electrode during the sustain discharge period.

Also, in the drive unit of the flat panel display in accordance with this invention, a push-pull type driver can be used, which enables high speed line sequential scanning. Power recovery is also possible by connecting two LC resonance circuit lines to the drive unit, so that a power saving type drive unit for a flat-panel display can be realized. Further the circuit arrangement the drive unit can be simplified by forming the driver circuit as a LSI, so as to provide an economical driver for a flatpanel display.

We claim:

1. A driver for a panel display system comprising n scan electrodes which are independent of each other, said driver comprising:

n driver circuits, respectively connected to said n scan electrodes;

a power supply for supplying a voltage to each of said n driver circuits; and a leakage current control circuit which leaks current caused by said voltage applied to each of said n driver circuits.

2. A driver for a panel display system according to claim 1, said voltage comprising a first voltage and a second voltage and wherein said power supply further comprises:

a first power supply circuit supplying the first voltage to the n driver circuits in order to write display data; and a second power supply circuit supplying the second voltage to the n driver circuits in order to produce discharges, based on said display data.

3. A driver for a panel display system according to claim 1, wherein each of said n driver circuits is a push-pull type driver circuit.

4. A driver for a panel display system according to claim 1, wherein said panel display system further comprises:

m address electrodes each crossing said n scan electrodes and the crossings of the n scan electrodes and the m address electrodes defining m×n cells between two substrates; and the m×n cells selectively generating discharge emissions when predetermined voltages are applied between the respective n scan electrodes and m address electrodes.

5. A driver for a panel display system according to claim 4, wherein said panel display system further comprises common electrodes connected to each other and positioned in parallel to the n scan electrodes and said m address electrodes being provided on one of the two substrates and said n scan electrodes and said common electrodes being provided on the other of the two substrates.

6. A driver for a panel display system according to claim 2, wherein said first power supply circuit comprises a first voltage generator generating a higher potential power supply voltage and a second voltage generator generating a lower potential power supply voltage, said first voltage generator being connected to a first power supply line connected to said n driver circuits and said second voltage generator being connected to a second power supply line connected to said n driver circuits.

7. A driver for a panel display system according to claim 1, wherein said n driver circuits are connected through a first power supply line and a second power supply line to said power supply, and wherein said leakage current control circuit is connected to the first power supply line.

8. A driver for a panel display system according to claim 2, wherein said second power supply circuit comprises a first voltage generator generating a lower potential power supply voltage and a second voltage generator generating a higher potential power supply voltage, said first voltage generator being connected to a first power supply line connected to said n driver circuits and said second voltage generator being connected to a second power supply line connected to said n driver circuits.

9. A driver for a panel display system according to claim 1, further comprising a power recovery circuit, said n driver circuits being connected to said power recovery circuit.

10. A driver for a panel display system according to claim 9, said power recovery circuit comprising a coil functioning as a series resonant circuit together with a panel capacitor, and said n scan electrodes providing one of two conductors of the panel capacitor.

11. A driver for a panel display system according to claim 6, wherein said first and second voltage generators are individually provided with respective switches for applying predetermined voltages to the n driver circuits in response to control signals applied thereto.

12. A driver for a panel display system according to claim 11, further comprising a diode connected between the first voltage generator and the first power supply line.

13. A driver for a panel display system according to claim 8, wherein said first and second voltage generators are individually provided with respective switches for applying predetermined voltages to the first and second power supply lines, respectively, in response to control signals applied thereto.

14. A driver for a panel display system according to claim 13, wherein said second power supply circuit further comprises diodes connected in parallel with said switches.

15. A driver for a panel display system according to claim 7, further comprising a resistor, connected between said leakage current control circuit and said first power supply line, which prolongs a transition time of a trailing edge of a waveform of said power supply.

16. A driver for a panel display system according to claim 8, wherein said first voltage generator of said second power supply circuit concurrently functions as said leakage current control circuit.

17. A driver for a panel display system according to claim 10, wherein said coil comprises a first coil functioning with the panel capacitor as a first series resonance circuit and a second coil functioning with the panel capacitor as a second series resonant circuit, the first and second coils being connected to a first power supply line and a second power supply line, respectively, and the first and the second power supply lines being connected between the power supply and the n driver circuits for supplying the voltage.

18. A driver for a panel display system according to claim 17, wherein said first and second coils have respective, different inductance values.

19. A driver for a panel display system according to claim 3, wherein said push-pull type driver circuit comprises a plurality of transistors and a plurality of diodes, each diode connected in parallel to a respective one of the transistors.

20. A driver for a panel display system according to claim 12, further comprising a resistor connected between the first voltage generator and said diode.

21. A driver for a panel display system according to claim 1, wherein said power supply and said leakage current control circuit are connected to said n driver circuits in common.

22. A driving method for a panel display system comprising a plurality of driver circuits, individually and respectively connected to a plurality of scan electrodes which are independent of each other, and a power supply line, connected in common to the plurality of driver circuits for applying a predetermined voltage to the plurality of driver circuits, comprising the steps of:

applying the predetermined voltage to the power supply line; and leaking current, caused by the predetermined voltage applied to the power supply line.

23. A driving method for a panel display system according to claim 22, further comprising the steps of:

successively scanning said scan electrodes in a scan period to thereby write display data; and effecting and sustaining a display based on the written display data in a sustain period after the scan period, wherein said applying step is executed in the scan period and said leaking step is executed at the end of the scan period.

24. A driving method for a panel display system according to claim 23, wherein a potential difference between both ends of the driver circuits is reduced to zero in the leaking step, and thereafter said sustain period starts.

25. A driver for a panel display system comprising n scan electrodes which are independent of each other, said driver comprising:

a plurality of n driver circuits provided between a first power supply line and a second power supply line and connected to the n scan electrodes;

a first power supply circuit supplying a first electric power to the first and second power supply lines, said first electric power writing display data; and a second power supply circuit supplying a second electric power to the first and second power supply lines, said second electric power producing discharges based on the display data.

26. A driver for a panel display system according to claim 25, wherein:

said first power supply circuit comprises:

a first voltage generator, connected to the first power supply line, generating a higher potential power supply voltage, and a second voltage generator, connected to the second power supply line, generating a lower potential power supply voltage; and said second power supply circuit comprises:

a third voltage generator, connected to the first power supply line, generating a lower potential power supply voltage, and a fourth voltage generator, connected to the second power supply line, generating a higher potential power supply voltage.

27. A driver for a panel display system according to claim 25, wherein each of the n driver circuits comprises a push-pull driver circuit of a plurality of transistors serially connected between the first and the second power supply lines.

28. A driver for a panel display system according to claim 27, wherein each push-pull driver circuit further comprises a plurality of diodes, each diode connected in parallel to a respective transistor of the plurality of serially connected transistors.

29. A driver for a panel display system according to claim 25, wherein each of said first, second, third and fourth voltage generators further comprises respective switches individually associated therewith and applying predetermined voltages to the first and second power supply lines connected thereto in response to control signals applied thereto.

30. A driver for a panel display system according to claim 25, wherein said first and second power supply lines are connected in common to the n driver circuits.

31. A driver circuit for a panel display system comprising a pair of electrodes defining a panel capacitance therebetween, the driver circuit being coupled to, and selectively charging and discharging, the electrodes to drive the panel display system, the driver circuit comprising:

a first path having a first end connected to a selected electrode of the pair of electrodes and a second end connected to a node and comprising, in succession, a first coil, a first diode having an anode thereof oriented toward the selected electrode, and a first switch, the first path providing a discharge path for discharging the electrodes therethrough;

a second path having a first end connected to the second electrode of the pair of electrodes and a second end connected to the node and comprising, in succession, a second coil, a second diode having a cathode thereof oriented toward the selected electrode, and a second switch having a first end connected to the selected electrode and a second end connected to the node, the second path providing a charging path for charging the electrodes therethrough;

a power storage element connected to the node;

a first clamp circuit, connected to the first path at a connection therein between the selected electrode and the first coil and clamping a potential of the first path to a first, low potential power source; and a second clamp circuit, connected to the second path at a connection therein between the selected electrode and the second coil and clamping a potential of the second path to a second, high potential power source, the high potential being higher than the low potential.

32. A driver circuit for a panel display system according to claim 31, further comprising:

a third diode having a cathode thereof connected to the first path at a connection therein between the first coil and the first diode and having an anode thereof connected to the first, low potential power source; and a fourth diode having an anode thereof connected to the second path at a connection therein between the second coil and the second diode and having a cathode thereof connected to the second, high potential power source.

33. A driver circuit for a panel display system according to claim 32, further comprising:

a fifth diode having a cathode thereof connected to the first path at a connection therein between the first switch and the first diode, and having a cathode thereof connected to the second, high potential power source; and a sixth diode having a cathode thereof connected to the second path at a connection therein between the second switch and the second diode, and having an anode thereof connected to the first, low potential power source.

34. A driver circuit for a panel display system according to claim 31, further comprising:

a seventh diode having a cathode thereof connected to the first path at a connection therein between the selected electrode and the first clamp circuit and having an anode thereof oriented toward the selected electrode; and an eighth diode having a cathode thereof connected to the second path at a connection therein between the second electrode and the second clamp circuit and having a cathode thereof oriented toward the selected electrode.

35. A driver for a panel display system according to claim 31, wherein said first and second coils have respective, different inductance values.

36. A panel display system comprising a pair of electrodes having a panel capacitance and generating discharge emissions therebetween in response to a predetermined voltage applied therebetween and a driver circuit coupled to the electrodes for driving the discharge emissions, said driver circuit comprising:

a first path having a first end connected to a selected electrode of the pair of electrodes and a second end connected to a node and comprising, in succession, a first coil, a first diode having an anode thereof oriented toward the selected electrode and a first switch, the first path providing a discharging path for discharging the electrodes therethrough;

a second path having a first end connected to the selected electrode and a second end connected to the node and comprising, in succession, a second coil, a second diode having a cathode thereof oriented toward the selected electrode and a second switch, the second path providing a charging path for charging the electrodes therethrough;

a power storage element connected to the node;

a first clamp circuit, connected to the first path at a connection therein between the selected electrode and the first coil and clamping a potential of the first path to a low potential; and a second clamp circuit, connected to the second path at a connection therein between the selected electrode and the second coil and clamping a potential of the second path to a high potential, the high potential being higher than the low potential.

37. A method of driving a panel display system comprising a pair of electrodes having a panel capacitance and generating discharge emissions therebetween in response to a predetermined voltage applied therebetween, the method comprising the steps of:

i) discharging the panel capacitance of the pair of electrodes through a discharging path comprising, in sequence, a first coil and a first diode;

ii) clamping potentials of the electrodes after step i);

iii) reducing a potential difference between opposite end terminals of the first coil to zero, concurrently with step ii);

iv) charging the panel capacitance of the electrodes through a charging path comprising, in sequence, a second diode and a second coil;

v) clamping potentials of the electrodes after step iv); and vi) reducing a potential difference between opposite end terminals of the second coil to zero concurrently with step v).

38. A method of driving a panel display system according to claim 37, wherein:

step iii) is performed through a conductive path comprising a third diode having a cathode thereof connected to a connection in the discharge path between the first coil and the first diode and having an anode thereof connected to the first, low potential power source; and step vi) is performed through a conductive path comprising a fourth diode having an anode thereof connected to a connection in the charging path between the second coil and the second diode and having a cathode thereof connected to the second, high potential power source.

39. A method of driving a panel display system according to claim 37, wherein step iv) further comprises a substep of applying a voltage which substantially corresponds to one half of a voltage level to which the panel capacitance is charged.

40. A method of driving a panel display system according to claim 37, wherein step i) further comprises the substep of applying a voltage which substantially corresponds to one half of a voltage level to which the panel capacitance is charged.

41. A method of driving a panel display system according to claim 37, wherein:

the first coil and the panel capacitance define a first serial resonant circuit and the potentials clamped in step ii) correspond to a peak value of a resonant voltage of the first serial resonant circuit; and the second coil and the panel capacitance define a second serial resonant circuit and the potentials clamped in step v) correspond to a peak value of a resonant voltage of the second serial resonant circuit.

* * * * *

UNITED STATES PATENT AND TRADEMARK OFFICE

CERTIFICATE OF CORRECTION

PATENT NO. : 5,786,794

DATED : July 28, 1998

INVENTOR(S) : Tomokatsu KISHI et al.

It is certified that error appears in the above-indentified patent and that said Letters Patent is hereby corrected as shown below:

Col. 4, line 59, begin a new paragraph with "The".

Col. 8, line 42, change "35" to --55--.

Signed and Sealed this

Second Day of February, 1999

*Attest:*

*Attesting Officer*

*Acting Commissioner of Patents and Trademarks*